United States Patent [19]

Tolasch et al.

[11] 4,207,720

[45] Jun. 17, 1980

[54] APPARATUS FOR FILLING CHARGERS WITH CIGARETTES OR THE LIKE

[75] Inventors: Gerhard Tolasch, Wentorf; Bernhard Schubert, Neubörnsen; Günter Menge, Hamburg, all of Fed. Rep. of Germany

[73] Assignee: Hauni-Werke Körber & Co. KG., Hamburg, Fed. Rep. of Germany

[21] Appl. No.: 880,575

[22] Filed: Feb. 23, 1978

[30] Foreign Application Priority Data

Mar. 5, 1977 [DE] Fed. Rep. of Germany ..... 2709700

[51] Int. Cl.[2] ..... B65B 19/04

[52] U.S. Cl. ..... 53/151; 53/236; 53/245; 221/200

[58] Field of Search ..... 53/148, 150, 151, 236, 53/245, 444, 535; 221/93, 200, 225

[56] References Cited

U.S. PATENT DOCUMENTS

| | | | |
|---|---|---|---|
| 2,821,828 | 2/1958 | Kernen | 53/245 |
| 2,826,883 | 3/1958 | Pollman | 53/236 |
| 3,241,286 | 3/1966 | Dearsley | 53/236 X |
| 3,320,717 | 5/1967 | Molins et al. | 53/236 X |
| 4,096,938 | 6/1978 | Payne | 53/151 X |

*Primary Examiner*—Travis S. McGehee
*Attorney, Agent, or Firm*—Peter K. Kontler

[57] ABSTRACT

The lower end portion of a magazine for parallel cigarettes or like rod-shaped articles contains a horizontal grid of parallel rods which divide the outlet opening of the lower end portion into parallel passages wherein the cigarettes descend into an empty tray therebelow. When the tray is filled (such filling takes place while the tray descends, either continuously or stepwise), the passages are blocked by rod-like closing members which are parallel to the rods of the grid and are movable from inoperative positions behind the rods of the grid to intercepting positions in or above the passages. The closing members are oscillated and/or vibrated to prevent jamming of passages and/or bridging of cigarettes above the grid. The mechanism for moving the closing members between inoperative and intercepting positions employs a pneumatic motor or an electromagnet which can shift a common carrier for the closing members. The mechanism is actuated in automatic response to completed filling of a tray.

21 Claims, 7 Drawing Figures

Fig.1
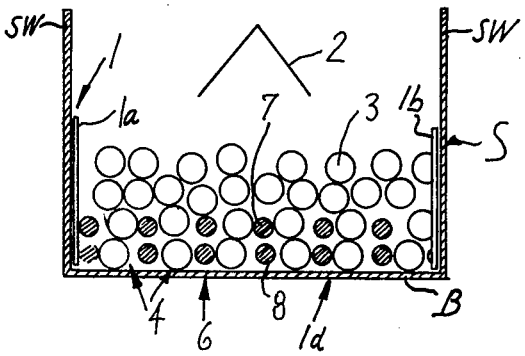
Fig.2
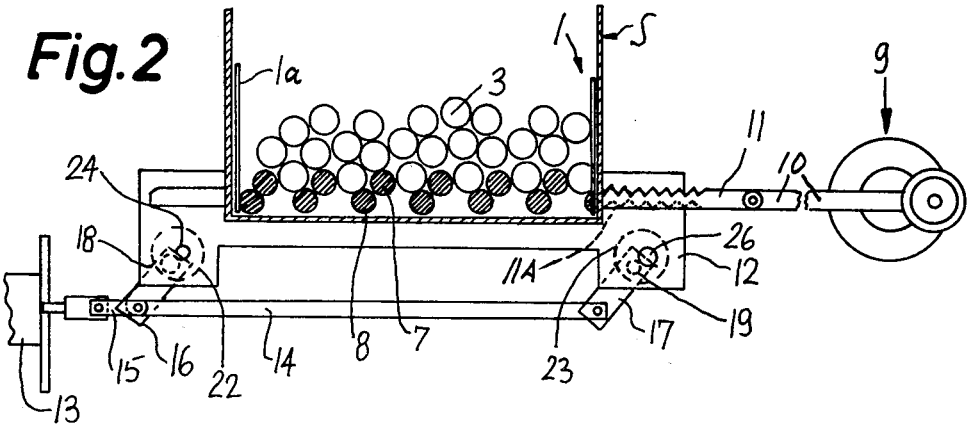
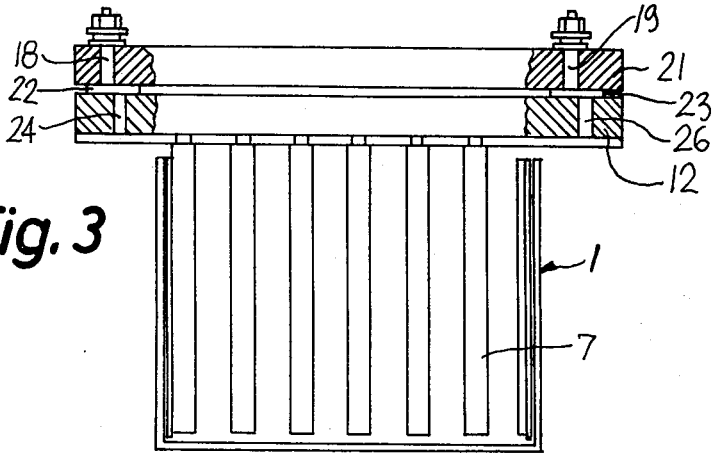
Fig. 3

136
134
109
105
129
115
110
120
107
107A
104
101
112
111
124
118
108
106
108A
B
V
S
116
133
131
122
212A
206
207
208
114
128
130
132
137
138
139
113
a
b
c
242
243
204
VII
103
141
121
127
125
101a
101b
102
SW
144
146
147
148
149

APPARATUS FOR FILLING CHARGERS WITH CIGARETTES OR THE LIKE

BACKGROUND OF THE INVENTION

The present invention relates to apparatus for manipulating plain or filter tipped cigarettes, cigars or cigarillos, filter rod sections and analogous rod-shaped articles which constitute or form part of smokers' products. More particularly, the invention relates to improvements in apparatus for introducing rod-shaped articles of the above-outlined character into containers, especially into containers of the type known as chargers or trays.

Chargers or trays are utilized for temporary storage of rod-shaped articles (hereinafter called cigarettes) prior to introduction into the magazine of a packing machine, prior to admission into the hopper of a pneumatic sender which propels the cigarettes into the magazines of further processing machines, or to take up the surplus output of a producing or processing machine. As a rule, the cigarettes are discharged under the action of gravity by issuing from the outlet opening in the lower end portion of a magazine. It is also known to divide the outlet opening into several passages for discrete streams of cigarettes and to provide the partitions between neighboring passages with oscillatory parts in order to reduce the likelihood of bridging of cigarettes in the interior of the magazine.

Apparatus of the just outlined character operate satisfactorily during admission of cigarettes into trays. However, their operation is less satisfactory during that stage which involves replacement of a filled tray with a fresh tray. In order to insure adequate filling of each tray, and especially to insure that each of a long series of trays will receive the same or nearly identical quantity of articles, the evacuation of cigarettes from the magazine must be interrupted abruptly as soon as a tray is filled. Such abrupt interruption of evacuation often (and almost invariably) results in damage to or in defacing of cigarettes which happen to be in or immediately downstream of the passages during closing of the outlet opening of the magazine. In many instances, the closure is a gate which is shifted sideways to a position below or to a position away from the passages in the lower end of the magazine.

British Pat. No. 1,093,532 discloses a magazine wherein the passages for evacuation of articles can be plugged by closing members which move upwardly counter to the direction of movement of articles during evacuation. Such closing members are likely to damage the articles and/or to change the orientation of articles in the passages.

German OS No. 2,166,666 discloses a conveyor system for stepwise lowering a container which is open at one of its sides and receives articles which are advanced axially.

British Pat. No. 1,450,050 discloses a magazine which admits articles into a stationary container while the container is at a standstill. The container includes a platform which is raised below the discharge opening of the magazine and descends in the container while the magazine discharge articles.

OBJECTS AND SUMMARY OF THE INVENTION

An object of the invention is to provide a novel and improved apparatus for filling containers, particularly those known as chargers or trays, with rod-shaped articles (especially cigarettes and/or other rod-shaped articles which constitute or form part of smokers' products) in such a way that the replacement of a freshly filled container with an empty container does not result in damage to or in defacing of articles in the region of the outlet opening of the magazine which dispenses articles into containers.

Another object of the invention is to provide novel and improved means for closing the outlet opening of a magazine for cigarettes or the like upon or in response to adequate filling of a container which receives articles from the magazine.

A further object of the invention is to provide a magazine of the above outlined character with closing means which do not interfere with but rather promote the admission of articles into containers.

An additional object of the invention is to provide a novel and improved magazine which embodies the above outlined closing means.

A further object of the invention is to provide novel and improved means for moving the closing means relative to the article stream or streams prior to removal of a filled container and subsequent to replacement of such filled container with an empty container.

An ancillary object of the invention is to provide multiple-purpose agitating means for cigarettes which are stored in and are in the process of being discharged from a magazine.

The invention is embodied in an apparatus for filling chargers, trays or similar containers with cigarettes or analogous rod-shaped articles which constitute or form part of smokers' products. The apparatus comprises a magazine which stores a supply of parallel rod-shaped articles and has an article-discharging outlet opening, a plurality of partitions disposed in and dividing the outlet opening into a plurality of passages for sidewise movement of articles in a direction from the interior of the magazine into a container which is outwardly adjacent to the opening, closing members, one for each passage and each movable from an inoperative position behind one of the partitions, as considered in the direction of movement of articles through the passages, to an intercepting position in which it prevents evacuation of articles by way of the respective passage, and means for moving the closing members between the inoperative and intercepting position to thereby respectively permit and interrupt the evacuation of articles from the magazine. Each closing member moves (or has a component of movement) in the direction of movement of articles through the passages during shifting of closing members to the intercepting positions.

The outlet opening is preferably defined by a lower end portion of the magazine, i.e., the closing members are preferably disposed above the respective partitions when they assume the inoperative positions. Each closing member may constitute an elongated rod of circular, oval or polygonal cross-sectional outline, and each partition preferably comprises at least one rod having a circular cross-sectional outline and being parallel to the rod-shaped closing members.

The apparatus preferably further comprises means for rotating the closing members about their respective axes and/or for vibrating the closing members, at least while the closing members dwell in the inoperative positions. This enables the closing members to agitate the adjacent articles and to thereby prevent jamming of passages and/or bridging of articles in the magazine inwardly of the partitions.

The means for moving the closing members between inoperative and intercepting positions preferably includes levers, disks and eccentric pins or analogous devices for confining the closing members to movement along arcuate paths during travel between inoperative and intercepting positions. The centers of curvature of such arcuate paths are preferably (but need not be) located on the axes of the associated rod-like partitions.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a fragmentary vertical sectional view of a portion of an apparatus which embodies one form of the invention, an empty tray being shown (in section) in a position it assumes during the initial stage of admission of articles into its interior and the closing members being shown in the inoperative positions;

FIG. 2 illustrates the structure of FIG. 1 with the closing members in intercepting positions, and the means for oscillating the closing members as well as the means for moving the closing members between inoperative and intercepting positions;

FIG. 3 is a fragmentary horizontal sectional view substantially as seen in the direction of arrows from the line III—III of FIG. 2;

DESCRIPTION OF THE PREFERRED EMBODIMENTS

Figures 4, 5, 6, 7:
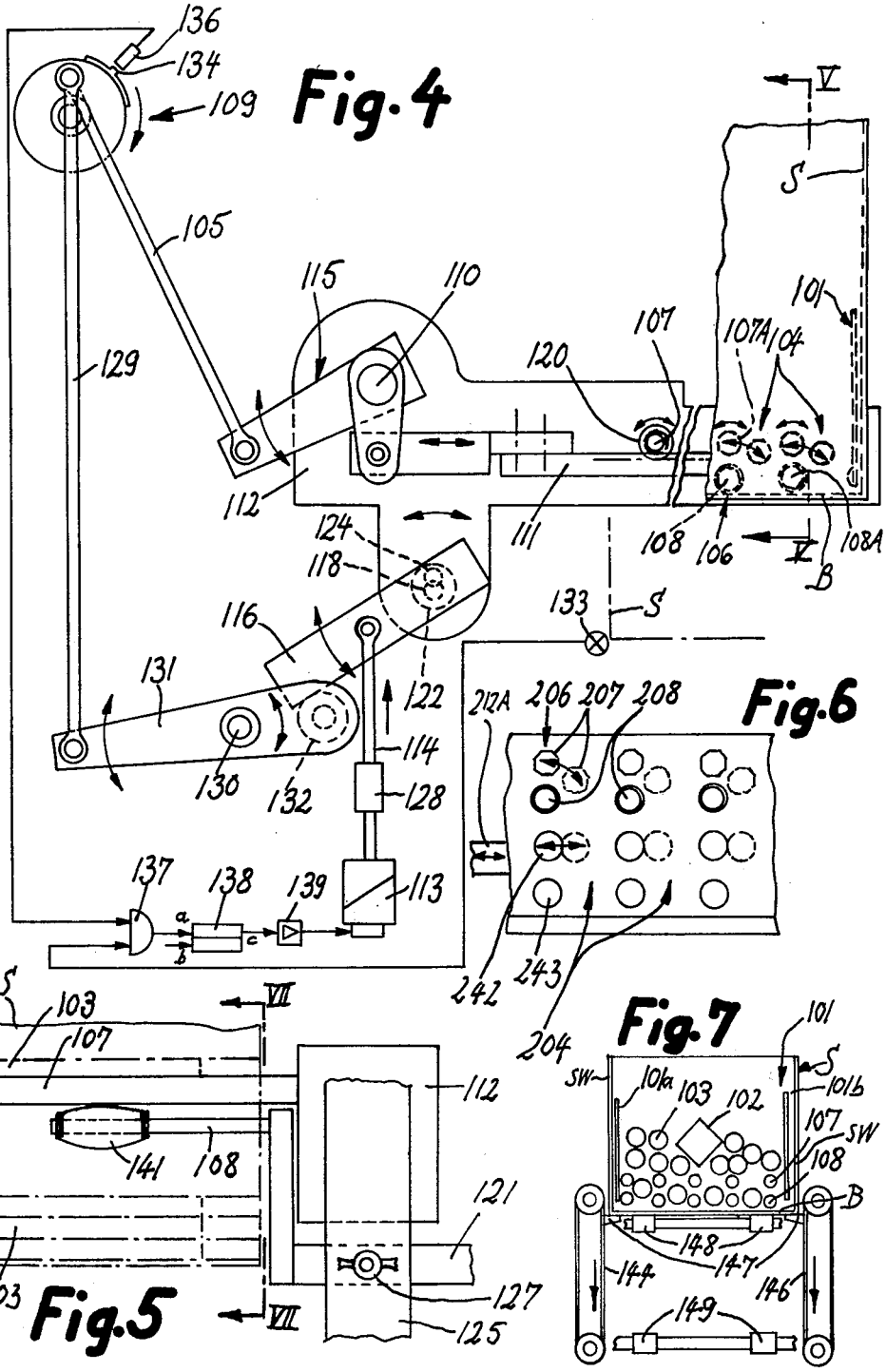
FIG. 4 is a fragmentary schematic elevational view of a second apparatus having modified means for moving the closing members between inoperative and intercepting positions and for moving the closing members about their respective axes, and further showing means for vibrating the closing members.
FIG. 5 is a sectional view as seen in the direction of arrows from the line V—V of FIG. 4.
FIG. 6 illustrates a portion of a third apparatus with modified closing means and modified partitions.
FIG. 7 illustrates the conveyor system for trays, substantially as seen in the direction of arrows from the line VII—VII of FIG. 5.

FIG. 1 shows a portion of an apparatus which embodies one form of the invention. The apparatus comprises a magazine or hopper 1 having a lower end portion including upright walls 1*a*, 1*b* and defining an outlet opening 1*d*. The magazine 1 contains a supply of parallel rod-shaped articles 3 (hereinafter called cigarattes) which are to be admitted into a container of the type known as charger or tray S. The tray S of FIG. 1 is empty, i.e., its bottom wall B is immediately adjacent to the lower end faces of the walls 1*a* and 1*b* and such bottom wall extends across the entire outlet opening 1*d*. During filling, the tray S is lowered, either continuously or stepwise, for example, in a manner as shown in FIG. 7. The upper end of the tray S is open and the tray may but need not be designed in such a way that its side walls SW are immediately adjacent to the outer sides of the magazine walls 1*a*, 1*b*. The magazine 1 is assumed to extend well above the open upper end of the tray S so that it can store a large supply of cigarettes 3. A roof-shaped spreading element 2 is installed in the magazine 1 to insure uniform distribution of descending cigarettes 3 in the entire space between the walls 1*a* and 1*b*. The magazine 1 can receive cigarettes 3 directly from a maker or from a suitable conveyor system, not shown.

The outlet opening 1*d* is divided into a series of parallel passages 4 by a set of parallel horizontal partitions 6 each of which includes an elongated rod 8 having a circular cross-section outline and being fixedly mounted in the lower end portion of the magazine 1. The width of each passage 4 suffices to permit successive cigarettes 3 to advance therethrough and to descend onto the bottom wall B of the tray S or onto the uppermost layer of cigarettes in the tray. The manner in which one or both end portions of each rod 8 are secured to the magazine 1 and/or to a stationary part of the frame or housing of the apparatus is not shown in the drawing. The rods 8 can be said to constitute a horizontal grid whose parts are equally spaced apart from each other and are parallel with the cigarettes 3 of the supply in the upper portion of the magazine 1.

In accordance with a feature of the invention, the apparatus further comprises elongated parallel rod-shaped closing members 7, one for each passage 4 and each movable from an inoperative position (shown in FIG. 1) behind (i.e., above) one of the rods 8 and a closing or intercepting position (shown in FIG. 2) in which the closing member 8 prevents further evacuation of cigarettes 3 from the interior of the magazine 1 and into and through the respective passage 4. It will be noted that, when moved to the intercepting or closing positions of FIG. 2, the members 7 need not extend all the way into those portions of the respective passages 4 which are disposed between the axes of the neighboring rods 8; it suffices if the closing members 7 are moved to positions in which they barely prevent further evacuation of cigarettes by way of the respective passages.

When the closing members 7 are held in the inoperative positions of FIG. 1, namely behind the adjacent rods 8 (as considered in the direction of travel of cigarettes 3 from the interior of the magazine 1 into the tray S), they actually constitute rearward extensions of the respective partitions 6. Thus, such closing members then prolong the respective passages 4, as considered in the direction of gravitational sidewise movement of cigarettes 3 into the tray S.

The apparatus comprises means for rotating the closing members 7, at least in the inoperative positions of FIG. 1. The rotating means comprises gears on those end portions of closing members 7 which are not confined in the magazine 1 (reference may be had to the gear 120 of FIG. 4), an elongated toothed rack 11 which meshes with the gears on the closing members 7, and a crank drive 9 for moving the rack 11 back and forth. When the motor of or for the crank drive 9 is on, the rack 11 causes the closing members 7 to rotate back and forth and to thus promote entry of cigarettes 3 into the adjacent passages 4. At the same time, the oscillating closing members 7 reduce the likelihood of bridging of cigarettes 3 in the regions immediately upstream of the passages 4. A portion of the connecting rod 10 between the crank pin of the drive 9 and the rack 11 may consist of elastomeric material so as to enable the rack to remain in mesh with the gears on the closing members 7 while the members 7 move between the positions of FIGS. 1 and 2.

The means for moving the closing members 7 between the positions of FIGS. 1 and 2 comprises a common plate-like carrier 12 for all closing members and means for moving the carrier with respect to the magazine 1 and tray S. The carrier 12 receives motion from a prime mover 13 (e.g., a double-acting pneumatic cylinder and piston unit) whose piston rod is articulately connected with a push rod 14 by means of a link 15. The push rod 14 is pivoted to the lower end portions of two levers 16, 17 which are secured to pivots 18, 19 rotatably mounted in a stationary frame member of support 21 and rigidly connected with two disks 22, 23 having pins 24, 26 parallel to the pivots 18, 19 and serving to couple the disks to the carrier 12. When the motor 13 moves the push rod 14 in a direction to the right, as viewed in FIG. 2, the levers 16, 17 are pivoted counterclockwise and cause the disks 22, 23 and their pins 24, 26 to move the carrier 12 upwardly and to the left whereby the closing members 7 return to the inoperative positions of FIG. 1. It will be noted that the disks 22, 23 and their pins 24, 26 confine the closing members 7 to movement along arcuate paths whose centers of curvature are (but need not be) located on the axes of the adjacent rods 8. If the motor 13 thereupon moves the push rod 14 in a direction to the left, the closing members 7 reassume the intercepting positions of FIG. 2. The manner in which the motor 13 receives signals to move the closing members 7 between the position of FIGS. 1 and 2 in response to detection of a filled tray and in response to detection of an empty tray (in the position of FIG. 1) is not shown in FIGS. 1 to 3. The signal generating means can monitor the position of the tray S with respect to the magazine 1, i.e., the tray is assumed to be filled when it descends to a predetermined level and an empty tray is in proper position for reception of cigarettes 3 when it assumes the upper end position of FIG. 1.

The distance between the pivot 18 and pin 24 or pivot 19 and pin 26 corresponds to the distance between a closing member 7 and the rod 8 therebelow (as viewed in FIG. 1). Such mounting of these parts insures that the closing members 7 are moved along arcuate paths which are centered on the axes of the corresponding rods 8.

An important advantage of the just described moving means for the closing members 7 is that the closing members move in the general direction of travel of cigarettes 3 from the interior of the magazine 1 during movement of closing members from the inoperative positions of FIG. 1 to the intercepting positions of FIG. 2. This insures that the closing members 7 are highly unlikely to damage or deface the cigarettes during movement to intercepting positions; in fact, the closing members assist the cigarettes which are adjacent thereto to move into and through the passages 6 which are about to be closed.

In accordance with a modification which is not specifically shown in the drawing, the rods 8 can be rotated back and forth and/or caused to perform sidewise movements along arcuate or straight paths (up and down or horizontally, as viewed in FIG. 1 or 2) in order to further reduce the likelihood of jamming the passages 4 and/or bridging of cigarettes 3 in the interior of the magazine 1 at a level above the closing members 7. For example, the rods 8 can be provided with gears in mesh with a row of teeth 11A indicated by broken lines at the underside of the rack 11 of FIG. 2. Oscillatory (up and down or horizontal) movements can be imparted to the rods 8 by eccentrically mounting their end portions in a stationary bearing structure, i.e., rotation of rods 8 under the action of the rack 11 can simultaneously and automatically entail back-and-forth movements of such rods.

FIG. 4 shows a portion of a second apparatus wherein the majority of parts which are identical with or clearly analogous to corresponding parts of the apparatus of FIGS. 1 to 3 are denoted by similar reference characters plus 100. The charger or tray S is shown in the upper end position in which its bottom wall B abuts against the lower edge faces of the walls constituting the lower end portion of the magazine 101. The cigarettes 103 (see FIGS. 5 and 7) descend into the tray S by advancing through a row of parallel passages 104 which are separated from each other by partitions 106 including horizontal rods 108 disposed below elongated rod-shaped closing members 107. Each of the two right-hand closing members 107 of FIG. 4 is shown in two positions, namely, in the left-hand end position which is the inoperative position and in which the closing member is located behind (above) the respective rod 108, and in the right-hand end position or intercepting position in which the closing member interrupts the evacuation of cigarettes 103 via the associated passage 104. The tray S descends stepwise or continuously, depending on the construction of the mechanism which supports the tray in a position of registry with the outlet opening of the magazine 101.

The closing members 107 may but need not have a circular cross-sectional outline. For example, FIG. 6 shows that the closing members (numbered 207) may be elongated rods having a regular or irregular polygonal cross-sectional outline. Since the closing members 107 rotate, all passages 104 of the outlet opening between the walls 101*a*, 101*b* (see FIG. 7) of the magazine 101 discharge cigarettes 103 at a constant rate so that the cigarettes which enter the tray S form a series of superimposed layers. In other words, the apparatus insures gradual filling of successive trays.

The means for rotating or oscillating the closing members 107 comprises a crank drive 109 whose crank pin transmits motion to an at least partially flexible (elastically deformable) connecting rod 105 coupled to one arm of a bell-crank lever 115 which is fulcrumed at 110. The connecting rod 105 is deformable in directions at right angles to the plane of FIG. 4. The shorter arm of the bell-crank lever 115 is coupled to a toothed rack 111 which meshes with the gears or pinions 120 of the closing members 107. The common carrier for the closing members 107 is shown at 112. This carrier further supports the shaft 110 for the bell-crank lever 115.

The means for moving the carrier 112, i.e., for moving the closing members 107 between the inoperative and closing or intercepting positions, comprises a prime mover here shown as an electromagnet 113 having a reciprocable armature 114 whose upper end portion is coupled to a lever 116. The lever 116 is mounted on a horizontal pivot member 118 which is rigid with a disk 122 having an eccentric pin 124 rotatable in the carrier 112. When the armature 114 is moved upwardly (in response to energization or deenergization of the electromagnet 113), the lever 116 is pivoted clockwise and the pin 124 causes the carrier 112 to move the closing members 107 to the intercepting positions. When the electromagnet 113 causes or enables the armature 114 to move downwardly, the carrier 112 returns the closing members 107 to their inoperative positions. The term "inoperative" is used to designate those positions in which the closing members 107 are incapable of preventing evacuation of cigarettes 103 from the magazine 101. However, the closing members 107 are not entirely inoperative because they are caused to oscillate and thus prevent bridging of cigarettes 103 in the magazine 101 while at the same time promoting entry of cigarettes into the adjacent passages 104.

The rods 108 are mounted on a frame member 121 (FIG. 5) which, in turn, is adjustably connected to an upright component 125 of the frame or housing by a connector 127 (e.g., a bolt and a winged nut). When the connector 127 is loosened, the frame member 121 can pivot with respect to the upright 125 to assume a position in which the rods 108 and the closing members 107 are inclined with respect to cigarettes 103 in the magazine 101. The connector 127 is thereupon tightened to maintain the parts 107, 108 in the newly selected positions. The frame member 121 further supports the pivot 118 for the lever 116.

The means for moving the closing members 107 between inoperative and intercepting positions comprises a shock absorber 128 or analogous cushioning means which further reduces the likelihood of damage to cigarettes 103 during movement of the closing members 107 to their intercepting positions. The shock absorber 128 is installed between the prime mover (electromagnet 113) and carrier 112. In the embodiment of FIG. 4, the armature 114 includes a lower portion which is movable on energization of the electromagnet 113 and an upper portion which is coupled to the lever 116. The shock absorber 128 connects the two portions of the armature 114 in such a way that the upper portion can move slowly while the lower portion moves at a higher speed. In a way, the shock absorber 128 acts not unlike a step-down transmission between the lower portion of the armature 114 and the carrier 112. This shock absorber may be a hydraulic, pneumatic or hydraulic-pneumatic device of any known design.

In addition to oscillating under the action of the crank drive 109, and in addition to moving between their inoperative and intercepting positions under the action of the prime mover 113, the closing members 107 of FIG. 4 perform further movements, namely, vibratory movements which are imparted by the crank drive 109 and serve to further reduce the likelihood of jamming of passages 104 and/or bridging of cigarettes 103 in the magazine 101 above the rods 108. A motion transmitting rod 129 connects the pin of the crank drive 109 with a two-armed lever 131 which is mounted on a fixed horizontal shaft 130. The right-hand arm of the lever 131 is provided with a roller 132 which abuts against the underside of the lever 116 and causes the latter to perform vibratory movements. Such movements are transmitted to the carrier 112 and hence to the closing members 107. The motion transmitting rod 129 is partially flexible (elastically deformable) in directions at right angles to the plane of FIG. 4. The lever 131 causes the closing members 107 to move up and down once during each orbital movement of the pin of the crank drive 109. When the armature 114 is caused to move upwardly, the lever 116 is lifted off the roller 132 because the extent of oscillatory movement of the right-hand arm of the lever 131 under the action of the rod 129 is less than the length of upward stroke of the armature 114.

The shock absorber 128 damps the movements of closing members 107 to intercepting positions. Thus, the closing members 107 need not move to intercepting positions at the speed which would be expected in view of relatively rapid axial movement of lower portion of the armature 114 in response to energization of the prime mover 113. In other words, a cigarette 101 which happens to be located in the path of movement of closing members 107 toward the intercepting positions has ample time to descend in the respective passage 104 and/or is gently nudged by the nearest closing member to enter into and to descend in such passage.

The apparatus of FIGS. 4 and 5 further comprises means for selecting the direction of rotation of closing members 107 at the time the carrier 112 is moved by the prime mover 113 in order to advance the closing members 107 to intercepting positions. The attendant can select the direction in which the closing members 107 turn during movement to intercepting positions in the following way: A photoelectronic detector 133 is positioned to transmit a signal when a tray S reaches the lower end position, i.e., when such tray is filled to capacity. The corresponding position of a tray is shown in FIG. 4 at S'. The detector 133 transmits the signal to one input of an AND-gate 137 the other input of which is connected with a proximity switch 136 actuatable by a magnet 134 or an analogous trip which rotates with the crank drive 109. FIG. 1 shows the proximity switch at approximately one o'clock position, i.e., slightly behind the upper dead center position of the crank drive. Thus, the connecting rod 105 moves the bell-crank lever 115 clockwise and the latter moves the rack 111 in a direction to the right, as viewed in FIG. 4, when the switch 134 transmits a signal to the corresponding input of the AND-gate 137. The closing members 107 are rotated counterclockwise, as viewed in FIG. 4. When both inputs of the AND-gate 137 receive signals at the same time, the output of the gate 137 transmits a signal to the setting input a of a conventional signal storing circuit 138. The output c of the circuit 138 transmits a signal to an amplifier 139 which energizes the prime mover 113 so that the latter causes the closing members 107 to move clockwise toward their intercepting positions while the closing members simultaneously turn counterclockwise about their respective axes.

If the attendant desires to change the direction of rotation of closing members 107 about their axes during movement to intercepting positions, the proximity switch 134 is moved clockwise or counterclockwise, e.g., to the seven o'clock position so that the rack 111 moves to the left (and the members 107 rotate clockwise) when the prime mover 113 is energized to move the closing members 107 to intercepting positions.

When the filled tray S' is replaced with an empty tray, the latter actuates a switch (not shown) which transmits a signal to the erasing input b of the signal storing circuit 138 so that the signal at the output c of the circuit 138 disappears. The prime mover 113 is deenergized and the closing members 107 return to their inoperative positions, i.e., the magazine 101 begins to discharge cigarettes 103 into the fresh tray S.

The possibility of selecting the direction of rotation of closing members 107 about their respective axes is a desirable feature because the closing members are less likely to damage or deform certain types of rod-shaped articles if they rotate about their axes in one direction while moving in the other direction toward intercepting positions. On the other hand, many types of articles are less likely to be damaged or defaced if the direction of rotation of closing members about their axes is the same as the direction of movement of closing members from inoperative to intercepting positions. For example, rotation of closing members 107 about their axes in one direction while the closing members move in the other direction toward intercepting positions may be desirable when the diameters of articles are not constant from end to end (this is the case when the articles are filter cigarettes, cigars or cigarillos) or when the hardness of articles is not uniform (this, too, is the case when the articles are filter cigarettes or the like because the tobacco-containing portion of a filter cigarette is more readily deformable than the filter mouthpiece).

Some or all of the rods 108 may be provided with substantially spherical barriers in the form of sleeves 141 (one shown in FIG. 5). These barriers are freely rotatable on the respective rods 108 and are mounted substantially midway between the ends of those portions of closing members 107 which extend into the magazine 101. The barriers 141 cooperate with the closing members 107 when the members 107 assume their intercepting positions to block the descent of cigarettes 103. The arrangement is such that the barrier 141 on a rod 108 cooperates with that closing member 107 which approaches the respective rod 108 during movement to intercepting position. With reference to FIG. 4, the barrier 141 (not shown) on the rod marked 108A will cooperate with the closing member marked 107A. The barriers 141 further reduce the likelihood of pinching of cigarettes 103 between the rods 108 and closing members 107 during movement of closing members to intercepting positions.

Another important advantage of the barriers 141 is that they enable a cigarette 103 which contacts a barrier to tilt in either of two directions about the adjacent portion of the spherical external surface of the barrier. Thus, a cigarette which rests on a barrier 141 acts not unlike a weighbeam and automatically assumes a horizontal or nearly horizontal position of parallelism with the majority of articles in the magazine when a cigarette descends onto such cigarette, either while the closing members 107 assume their intercepting positions or during movement of closing members back to the inoperative positions. In other words, the barriers 141 promote automatic reorientation of misoriented cigarettes to thus reduce the likelihood of improper stacking of cigarettes in the bottom zone of a fresh tray. Since the cigarettes which rest on the barriers 141 can tilt in two different directions, they are highly unlikely to break when engaged by cigarettes which descend from the interior of the magazine 101. The feature that the barriers 141 are sleeves which are freely rotatable on the rods 108 also reduces the likelihood of damage to or defacing of cigarettes which come in contact with and are temporarily held by the barriers.

FIG. 6 shows a portion of a modified apparatus. As mentioned above, the closing members 207 of FIG. 6 have a regular or irregular polygonal cross-sectional outline to further enhance their agitating action. Furthermore, each partition 206 comprises two rods 208, 243 with the rod 243 located downstream of, parallel to and spaced apart from the rod 208. Still further, each partition 206 comprises an intermediate rod 242 which is movable between a position of register with the associated rods 208, 243 and a position (shown by broken lines) in the respective passage 204. A carrier 212A is provided to move the rods 242 to the broken-line positions, i.e., into the passages 204, simultaneously with movement of closing members 207 to intercepting positions. The purpose of the rods 242 and 243 is to correct the orientation of certain cigarettes which happen to lie askew during or as a result of movement of closing members 207 to intercepting positions. The rods 208, 242, 243 then cause the cigarettes which lie askew but are free to advance beyond the closing members 207 (in intercepting positions) to bounce or cascade from rod 208 to rod 242 and thereupon to rod 243 and to thereby correct their orientation prior to descending into a fresh tray in response to return movement of closing members 207 to their inoperative positions. Such return movement of closing members 207 takes place simultaneously with return movement of rods 242 to the solid-line positions of FIG. 6.

The rods 242 can be said to constitute auxiliary closing members which block the passages 204 downstream of (i.e., below) the closing members 207. It is clear that the rods 242 and/or 243 can be caused to rotate about their axes and/or to perform vibatory movements in order to further reduce the likelihood of jamming the passages 204. Furthermore, the rods 242 can be moved along arcuate paths, the same as the closing members 207.

The advantages of partitions 206 of FIG. 6 will be readily appreciated by considering the following situation which is highly likely to arise during movement of closing members 207 to intercepting positions. If the articles which are evacuated from the magazine of FIG. 6 are filter cigarettes, i.e., articles having larger-diameter filter-containing ends and smaller-diameter tobacco-containing ends, the larger-diameter end of an article is likely to be held by a rod 208 and the adjacent closing member 207 whereas the remaining major portion hangs into the passage 204 therebelow. Such article is likely to wiggle free and to descend in the passage therebelow before the respective closing member reaches its intercepting position. However, temporary retention of the larger-diameter end resulted in tilting of the article, i.e., the article is not parallel to the parts 207 and 208. Such article then drops onto the rod 242 therebelow and is partially aligned before it descends onto the rod 243 therebelow and comes to rest on such rod while also lying against the adjacent rod 242. This invariably or often results in complete reorientation of the article so that it is in an optimum orientation when the closing members 207 return to inoperative positions simultaneously with retraction of rods 242 to the solid-line positions of FIG. 6. It can be said that the rods 242 and 243 provide a last chance to correct the orientation of articles before the articles are free to descend into a tray which registers with the lower end portion of the magazine.

Referring to FIG. 7, an empty tray S is shown in the requisite position for reception of cigarettes from the magazine 101. The bottom wall B of the tray S is supported by projections or lugs 147 of two endless chain or belt conveyors 144, 146 whose vertical inner stretches are parallel to the planes of the walls **101*a*, 101*b*. A horizontal conveyor 148 serves to feed empty trays S into register with the lower end portion of the magazine 101, and a horizontal take-off conveyor 149 serves to remove filled trays in a direction at right angles to the plane of FIG. 7. The drives for the conveyors of FIG. 7 are not shown. The conveyors 148 and 149 can be driven in a single direction and the drive or drives for the conveyors 144, 146 comprise one or more reversible motors so that the lugs 147 return to the upper end positions of FIG. 7 when a filled tray S is deposited on and removed by the take-off conveyor 149. It is assumed that one side of each tray S is open so that an empty tray can be moved into register with the lower end portion of the magazine 101 by moving at right angles to the plane of FIG. 7. It suffices to provide each tray S with only two side walls, namely with the side walls SW which are actually shown in FIG. 7. Such side walls are parallel with the longitudinal directions of cigarettes 103 which are stored in and thereupon discharged from the magazine 101**.

The drives for the conveyors of FIG. 7 can be controlled by automatic monitoring means. For example, the detector 133 of FIG. 5 can be used to initiate the movement of take-off conveyor 149 as soon as a filled tray S reaches the lower end position S', to thereupon initiate (with a requisite delay) the movement of conveyors 144, 146 so as to return the lugs 147 to the positions shown in FIG. 7, and to thereupon initiate (again with a requisite delay) the movement of conveyor 148 in order to advance an empty tray into register with the outlet opening of the magazine 101. Other types of controls including limit switches or the like can be used with equal advantage. Still further, the conveyors of FIG. 7 constitute but one form of means for moving empty, partially filled and completely filled trays with respect to the magazine. For example, the conveyors 144, 146 can be replaced with vertical feed screws which mesh with nuts having lugs corresponding to the lugs 147, and the take-off conveyor 149 can be replaced with a pusher which shifts a filled tray in a direction at right angles to the plane of FIG. 7 as soon as the filled tray descends to a predetermined lowermost level.

The utilization of trays which are open at one side or at two opposite sides renders it possible to reduce the dimensions of the apparatus because such trays can be moved to the positions shown in FIGS. 1 and 7 by moving sideways rather than upwardly. Thus, the conveyor 148 can transport successive empty trays in such a way that the bottom wall B of each empty tray is immediately adjacent to the lower end faces of the walls 101*a*, 101*b*. This reduces the space requirements of the conveyor system and of the entire apparatus. Accurate positioning of empty trays with respect to the magazine can be achieved by dimensioning the lower end portion of the magazine in a manner as shown in FIGS. 1 and 7, i.e., so that the side walls SW of an empty tray are immediately adjacent to the outer sides of the walls 1*a*, 1*b* or 101*a*, 101*b*.

An important advantage of the improved apparatus is that the closing members are highly unlikely to damage or deface the articles during movement to intercepting positions. This is attributed to the fact that each closing member moves (or has a component of movement) in the direction of travel of articles through the passages while the closing members advance from the inoperative to the intercepting positions. An advantage of movement of closing members along arcuate paths is that the closing members advance to intercepting positions by gradually entering the paths of articles which are on their way from the interior of the magazine toward and through the passages. This, too, contributes to gentle treatment of those articles which are engaged by the closing members and/or by the rods of the partitions while the closing members advance toward as well as when the closing members dwell in their intercepting positions. The same applies for movement of closing members from intercepting to inoperative positions; in fact, such movements are even less likely to affect the appearance and/or shape of the adjacent articles. Some displacement of articles counter to the direction of movement through the passages will take place while the closing members are returned to inoperative positions. However, the articles are idle when such movement of the closing members begins. On the other hand, the closing members do not compel the articles to move upwardly (counter to the direction of evacuation from the magazine) while the closing members are caused to move to the positions corresponding to those shown in FIG. 2.

The likelihood of damage to or defacing of articles is further reduced if the closing members as well as the constituents of the partitions are rods having a circular or oval cross sectional outline. The peripheral surfaces of such rods are highly unlikely to pinch or otherwise forcibly engage and deform or destroy the adjacent articles. Since the articles, too, are elongated cylinders, they merely roll about their own axes during movement relative to the partitions and/or closing members.

As mentioned above, the improved apparatus is also suited for filling of chargers, trays or analogous containers with filter cigarettes, cigars or cigarillos. The diameter of the tipped end of a filter cigarette, cigar or cigarillo normally exceeds the diameter of the tobacco-containing end. Therefore, when a tray accumulates a supply of filter-tipped articles, the uppermost layer of the supply is not horizontal. The aforementioned mounting of the carrier (112) and rods (108) of the partitions on a frame member (121) which can be adjusted relative to a fixed frame member (125) renders it possible to compensate for the fact that the layers of filter cigarettes or the like in a tray are not horizontal, especially when the tray is nearly filled with filter-tipped articles. Thus, an attendant will change the inclination of the parts 107, 108 with respect to a horizontal plane when the apparatus is converted from feeding of plain cigarettes to feeding of filter cigarettes or vice versa. When the diameters of articles which are discharged from the magazine are constant from end to end, the parts 107, 108 are preferably mounted in such a way that their axes are horizontal, i.e., parallel to the bottom wall of the tray. On the other hand, some inclination of parts 107, 108 when the articles are filter cigarettes or the like insures that the filter plugs of cigarettes in the uppermost layer of filter cigarettes when a tray is nearly filled with such articles do not contact the partitions during the last stage of filling to capacity.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. Apparatus for filling trays or similar containers with cigarettes or analogous rod-shaped articles which constitute or form part of smokers' products, comprising a magazine arranged to store a supply of parallel articles and having a lower end portion defining an article-discharging opening; a plurality of partitions disposed in and dividing said opening into a plurality of passages for sidewise downward movement of articles in a direction from the interior of said magazine into a container which is outwardly adjacent to said opening;

closing members, one for each of said passages and each movable from an inoperative position above one of said partitions, as considered in said direction, to an intercepting position to thereby prevent the evacuation of articles by way of the respective passage, said closing members including elongated parallel rods; means for rotating said closing members, at least in said inoperative positions of said closing members; and means for moving said closing members between said inoperative and intercepting positions to thereby respectively permit and interrupt the evacuation of articles from said magazine, each of said closing members having a component of movement in the direction of downward movement of articles during movement of said closing members to said intercepting positions thereof.

2. Apparatus as defined in claim 1, wherein said moving means includes means for confining said closing members to movement along arcuate paths during travel between said inoperative and intercepting positions.

3. Apparatus as defined in claim 1, wherein said partitions are elongated and parallel to each other and said arcuate paths are centered at or close to the longitudinal axes of said partitions.

4. Apparatus as defined in claim 1, wherein said partitions include elongated parallel rods having a substantially circular cross-sectional outline.

5. Apparatus as defined in claim 4, wherein said partitions and said closing members are substantially horizontal and substantially parallel to each other.

6. Apparatus as defined in claim 1, wherein said comprises said rotating means comprising gears provided on said rods, a toothed rack meshing with said gears, and means for reciprocating said rack.

7. Apparatus as defined in claim 6, wherein said reciprocating means comprises a crank drive.

8. Apparatus as defined in claim 1, wherein said moving means comprises a common carrier for said closing members.

9. Apparatus as defined in claim 1, wherein said partitions together constitute a first set of parallel rods and said closing members together constitute a second set of parallel rods, and further comprising substantially spherical barriers provided on the rods of at least one of said sets and cooperating with the rods of the other of said sets in intercepting positions of said closing members to prevent the evacuation of articles via said passages.

10. Apparatus as defined in claim 9, wherein said barriers are sleeves which are rotatable on the respective rods.

11. Apparatus as defined in claim 10, wherein said sleeves are provided on the rods of said first set.

12. Apparatus as defined in claim 1, further comprising second closing members disposed in front of said partitions, as considered in said direction, and means for moving said second closing members from first positions of register with said partitions to second positions in neighboring passages simultaneously with movement of said first mentioned closing members from inoperative to intercepting positions.

13. Apparatus as defined in claim 12, wherein said last mentioned moving means comprises means for reciprocating said second closing members between said first and second positions.

14. Apparatus as defined in claim 1, further comprising conveyor means for lowering the container which is outwardly adjacent to said opening during admission of articles into such container.

15. Apparatus as defined in claim 14 for filling containers of the type having an open top for admission of articles thereinto, wherein said conveyor means includes a plurality of conveyors having vertical portions supporting the container which is in the process of receiving articles from said magazine.

16. Apparatus for filling trays or similar containers with cigarettes or analogous rod-shaped articles which constitute or form part of smokers' products, comprising a magazine arranged to store a supply of parallel articles and having an article-discharging opening; a plurality of partitions disposed in and dividing said opening into a plurality of passages for sidewise movement of articles in a direction from the interior of said magazine into a container which is outwardly adjacent to said opening; closing members, one for each of said passages and each movable from an inoperative position behind one of said partitions, as considered in said direction, to an intercepting position to thereby prevent the evacuation of articles by way of the respective passage; a stationary support; and means for moving said closing members between said inoperative and intercepting positions to thereby respectively permit and interrupt the evacuation of articles from said magazine, said moving means comprising a common carrier for said closing members, a rotary member mounted on said support, an eccentric pin coupling said rotary member to said carrier, and means for moving said rotary member relative to said support whereby said pin determines the path of movement of said carrier relative to said support.

17. Apparatus as defined in claim 16, wherein said means for moving said carrier comprises a lever affixed to said rotary member and means for pivoting said lever back and forth including a rod articulately connected to said lever and means for reciprocating said last mentioned rod.

18. Apparatus for filling trays or similar containers with cigarettes or analogous rod-shaped articles which constitute or form part of smokers' products, comprising a magazine arranged to store a supply of parallel articles and having an article-discharging opening; a plurality of partitions disposed in and dividing said opening into a plurality of passages for sidewise movement of articles in a direction from the interior of said magazine into a container which is outwardly adjacent to said opening; closing members, one for each of said passages and each movable from an inoperative position behind one of said partitions, as considered in said direction, to an intercepting position to thereby prevent the evacuation of articles by way of the respective passage; and means for moving said closing members between said inoperative and intercepting positions to thereby respectively permit and interrupt the evacuation of articles from said magazine, said moving means including shock absorber means arranged to cushion the impact of said closing members upon the articles in said passages during movement of said closing members to said intercepting positions.

19. Apparatus as defined in claim 18, wherein said moving means further comprises a common carrier for said closing members and prime mover means for moving said carrier, said shock absorber means being interposed between said carrier and said prime mover means.

20. Apparatus for filling trays or similar containers with cigarettes or analogous rod-shaped articles which constitute or form part of smokers' products, comprising a magazine arranged to store a supply of parallel articles and having an article-discharging opening; a plurality of partitions disposed in and dividing said opening into a plurality of passages of sidewise movement of articles in a direction from the interior of said magazine into a container which is outwardly adjacent to said opening; closing members, one for each of said passages and each movable from an inoperative position behind one of said partitions, as considered in said direction, to an intercepting position to thereby prevent the evacuation of articles by way of the respective passage, said partitions including elongated rods and said closing members constituting elongated rods parallel with the rods of said partitions; a first support for said rods; a second support for said first support; connector means adjustably securing said first support to said second support so as to allow for changes in inclination of said rods with respect to the articles in said magazine; and means for moving said closing members between said inoperative and intercepting positions to thereby respectively permit and interrupt the evacuation of articles from said magazine.

21. Apparatus for filling trays or similar containers with cigarettes or analogous rod-shaped articles which constitute or form part of smokers' products, comprising a magazine arranged to store a supply of parallel articles and having an article-discharging opening; a plurality of partitions disposed in and dividing said opening into a plurality of passages for sidewise movement of articles in a direction from the interior of said magazine into a container which is outwardly adjacent to said opening; closing members, one for each of said passages and each movable from an inoperative position behind one of said partitions, as considered in said direction, to an intercepting position to thereby prevent the evacuation of articles by way of the respective passage; means for moving said closing members between said inoperative and intercepting positions to thereby respectively permit and interrupt the evacuation of articles from said magazine; means for rotating said closing members clockwise and counterclockwise; and means for selecting the direction of rotation of said closing members during movement from said inoperative to said intercepting positions.

* * * * *